US005749248A

United States Patent [19]

Kim

[11] Patent Number: 5,749,248

[45] Date of Patent: May 12, 1998

[54] WASHING MACHINE HAVING A DETACHABLE WASHING BUCKET

[75] Inventor: Sung-Bum Kim, Seoul, Rep. of Korea

[73] Assignee: Daewoo Electronics Co., Ltd., Seoul, Rep. of Korea

[21] Appl. No.: 580,596

[22] Filed: Dec. 29, 1995

[30] Foreign Application Priority Data

Apr. 29, 1995 [KR] Rep. of Korea ..... 95-9064

[51] Int. Cl.[6] ..... D06F 1/12

[52] U.S. Cl. ..... 68/4; 68/27

[58] Field of Search ..... 68/4, 27, 12.05

[56] References Cited

U.S. PATENT DOCUMENTS

| | | | |
|---|---|---|---|
| 2,119,677 | 6/1938 | Labisky | 68/4 |
| 3,029,623 | 4/1962 | Morey | 68/4 |
| 3,324,688 | 6/1967 | Hubbard | 68/4 |
| 3,327,506 | 6/1967 | Jacobsen | 68/4 |
| 3,509,740 | 5/1970 | Bochan | 68/4 |
| 3,575,020 | 4/1971 | Hubbard | 68/4 |
| 4,175,409 | 11/1979 | Morey | 68/4 |
| 4,481,162 | 11/1984 | Ziegler | 68/4 |
| 4,637,231 | 1/1987 | McMillan et al. | 68/4 |
| 4,673,230 | 6/1987 | Roberts | 68/6 |

FOREIGN PATENT DOCUMENTS

| | | | |
|---|---|---|---|
| 63-105793 | 5/1988 | Japan | 68/4 |

*Primary Examiner*—Frankie L. Stinson

*Attorney, Agent, or Firm*—Beveridge, DeGrandi, Weilacher & Young, LLP

[57] ABSTRACT

A washing machine for washing extremely dirty clothes or shoes is disclosed. The washing machine has a housing, an outer tub for receiving the washing liquid, a spin tub disposed in the outer tub, a motor for generating a driving force, a pulsator for generating a swirl-shaped liquid flow in the spin tub, and a detachable washing bucket for receiving the extremely dirty articles so as to wash the articles therein. The washing bucket has a cylindrical body formed at its inner wall with a washing brush. A washing bucket cover is hinged to the upper portion of the body. A plurality of guide pins are formed at the underside of the body and extend downwards therefrom so as to be inserted into the pulsator. The washing bucket is securely fixed to the pulsator by means of a bolt.

8 Claims, 3 Drawing Sheets

WASHING MACHINE HAVING A DETACHABLE WASHING BUCKET

BACKGROUND OF THE INVENTION

1. Field of the Invention

The present invention relates to a washing machine, and more particularly to a washing machine having a detachable washing bucket which separately receives extremely dirty clothes or shoes for washing them therein.

2. Prior Arts

A washing machine is an appliance for separating dirt from articles being washed such as clothes or shoes by sequentially carrying out various cycles in the order of water feeding, washing, rinsing, dehydrating, and draining cycles.

While the above cycles are executed, dirt contained in the articles is separated from the clothing by means of a detergent or by means of friction between the washing liquid and the articles.

In order to improve the washing effect, conventional washing machines use a spraying nozzle apparatus which is provided above the upper portion of a spin tub, in order to spray the washing liquid onto the articles loaded in the spin tub while the washing cycle is being executed.

FIG. 3 shows a conventional washing machine 500.

As shown in FIG. 3, washing machine 500 has a housing 505 formed at its upper portion with a housing cover 580. Disposed in housing 505 are an outer tub 510 for receiving the washing liquid therein, and a spin tub 520 which is accommodated in outer tub 510 and which has a plurality of discharging holes 522 at its side wall. At the bottom wall of spin tub 520, there is provided a pulsator 550 for generating a swirl-shaped liquid flow in spin tub 520.

In addition, a motor 530 for generating a rotational force, a gear assembly 540, which is connected to motor 530 by means of a belt 535 so as to receive the rotational force from motor 530, and a circulation pump 590 which communicates with outer tub 510 through a discharge tube 592, are all disposed at the lower portion of housing 505.

In order to transfer the rotational force from motor 530 to pulsator 550, a connection member 542 is disposed between a rotating shaft 552 of pulsator 550 and gear assembly 540. Circulation pump 590 circulates the washing liquid into a spraying nozzle apparatus 570, which is mounted on the upper portion of outer tub 510, through a circulation tube 594. Alternatively, circulation pump 590 drains the washing liquid out of washing machine 500 through a drain tube 560.

Washing machine 500 being constructed as described above operates as follows.

Firstly, when the user turns on the operating switch installed on housing cover 580, an operating signal is inputted to an electrical control unit (ECU, not shown) which is installed in washing machine 500. Upon receiving the operating signal, the ECU applies an open signal to a liquid feeding control valve (not shown) according to a predetermined algorithm which is preset in the ECU, so that the washing liquid is supplied from a liquid source into outer tub 510 through the liquid feeding control valve.

The washing liquid is continuously supplied until it has reached a predetermined liquid level in outer tub 510. When the liquid level in outer tub 510 has reached the predetermined liquid level, the ECU applies a close signal to the liquid feeding control valve. At the same time, the ECU applies an operating signal to motor 530 so that motor 530 periodically rotates in the forward and reverse directions.

The rotational force of motor 530 is transmitted to rotating shaft 552 of pulsator 550 by way of belt 535, gear assembly 540, and connection member 542 so that pulsator 550 rotates in the forward and reverse directions, and thereby generates a swirl-shaped liquid flow in spin tub 520.

At this time, dirt contained in the clothing loaded in spin tub 520 is separated from the clothing by friction between the clothing and the swirl-shaped liquid flow.

While the washing cycle is being executed, the ECU also applies an operating signal to circulation pump 590 so that the washing liquid that has supplied into outer tub 510 is discharged into circulation pump 590 through discharge tube 592.

Upon receiving the washing liquid, circulation pump 590 circulates the washing liquid into spraying nozzle apparatus 570 through circulation tube 594. Then, spraying nozzle apparatus 570 sprays the washing liquid onto the clothing with a strong force so that the washing liquid collides with the clothing, and thereby improving the washing effect.

When the washing cycle has finished, the washing liquid filled in outer tub 510 is drained out of washing machine 500 through drain port 560.

However, the conventional washing machine has the following disadvantages.

Firstly, since the conventional washing machine evenly washes the articles in the spin tub, the relatively dirty articles may contain dirt therein even when the other articles have been washed cleanly. For this reason, the conventional washing machine either takes long time to completely wash the dirty articles, or requires the dirty articles to be manually washed in advance.

Furthermore, since the articles in the spin tub are washed by means of friction between the swirl-shaped liquid flow and the articles, dirt such as stains or blots do not easily separate from the articles.

SUMMARY OF THE INVENTION

The present invention has been made to overcome the above described problems of the prior arts, and accordingly it is an object of the present invention to provide a washing machine which can cleanly wash even extremely dirty articles, and can easily separate dirt such as stains or blots from the articles.

To achieve the above object, the present invention provides a washing machine comprising:

- a housing;
- an outer tub disposed in the housing so as to receive washing liquid from a liquid source;
- a spin tub accommodated in the outer tub;
- a motor for generating a driving force, the motor disposed at a lower portion of the outer tub;
- a pulsator for generating a swirl-shaped liquid flow in the spin tub, the pulsator being rotated by the motor;
- a detachable washing bucket for receiving an extremely dirty article so as to wash the article therein, the detachable washing bucket being rotated as the pulsator rotates;
- a bolt for fixing the detachable washing bucket to the pulsator; and
- a plurality of guide pins for detachably assembling the detachable washing bucket to the pulsator.

According to the preferred embodiment of the present invention, the detachable washing bucket has a cylindrical body. The cylindrical body is formed at its upper portion with a detachable washing bucket cover for preventing the articles from coming out of the detachable washing bucket. The cylindrical body has a plurality of rectangular cutting portions at its cylindrical side wall for receiving the washing liquid from the spin tub. Further, the cylindrical body has a washing brush at its inner wall.

The pulsator is mounted on the bottom wall of the spin tub. The pulsator has a screw hole at the center thereof, and a plurality of guide holes which are regularly positioned around the screw hole.

The guide pins extend downwards from the underside of the cylindrical body so as to be inserted into the guide holes of the pulsator. The bolt is inserted in the screw hole of the pulsator.

The washing machine constructed as described above operates as follows.

Firstly, when it is necessary to wash general articles, the user separates the detachable washing bucket from the pulsator and puts the articles into the spin tub. Then, as the user turns on the operating switch, the washing machine performs the washing cycle in a well known manner.

On the other hand, when it is necessary to wash extremely dirty clothing or shoes, the user puts these articles into the detachable washing bucket.

In this state, as the user turns on the operating switch, the washing liquid is supplied from the liquid source into the outer tub according to the predetermined algorithm which is preset in the ECU.

When the liquid level in the outer tub reaches the predetermined liquid level, the ECU applies an operating signal to the motor so that the motor rotates in the forward and reverse directions.

The rotational force of the motor is transferred to the pulsator so that the pulsator also rotates in the forward and reverse directions, and thereby generating the swirl-shaped liquid flow in the spin tub.

The swirl-shaped liquid flow passes through the cutting portions and collides with the articles loaded in the detachable washing bucket, so that dirt may separate from the articles.

On the other hand, since the detachable washing bucket also rotates in the forward and reverse directions together with the pulsator, the articles loaded in the detachable washing bucket are subjected to the centrifugal force. Therefore, the articles make in contact with the washing brush provided at the inner wall of the detachable washing bucket so that the articles may rub with washing brush 150, and thereby dirt which is deeply permeated in the articles is easily separated from the articles by the washing brush.

As described above, the washing machine of the present invention can wash even extremely dirty articles without manually washing the articles in advance.

Further, since the articles in the detachable washing bucket rub against the washing brush provided at the inner wall of the detachable washing bucket, the washing machine of the present invention can effectively remove dirt from clothing, as well as from shoes and bags.

BRIEF DESCRIPTION OF THE DRAWINGS

The above objects and other advantages of the present invention will become more apparent by describing in detail preferred embodiments thereof with reference to the attached drawings, in which.

DESCRIPTION OF THE PREFERRED EMBODIMENTS

Hereinafter, the present invention will be described in detail with reference to the accompanying drawings.

Figure 1:
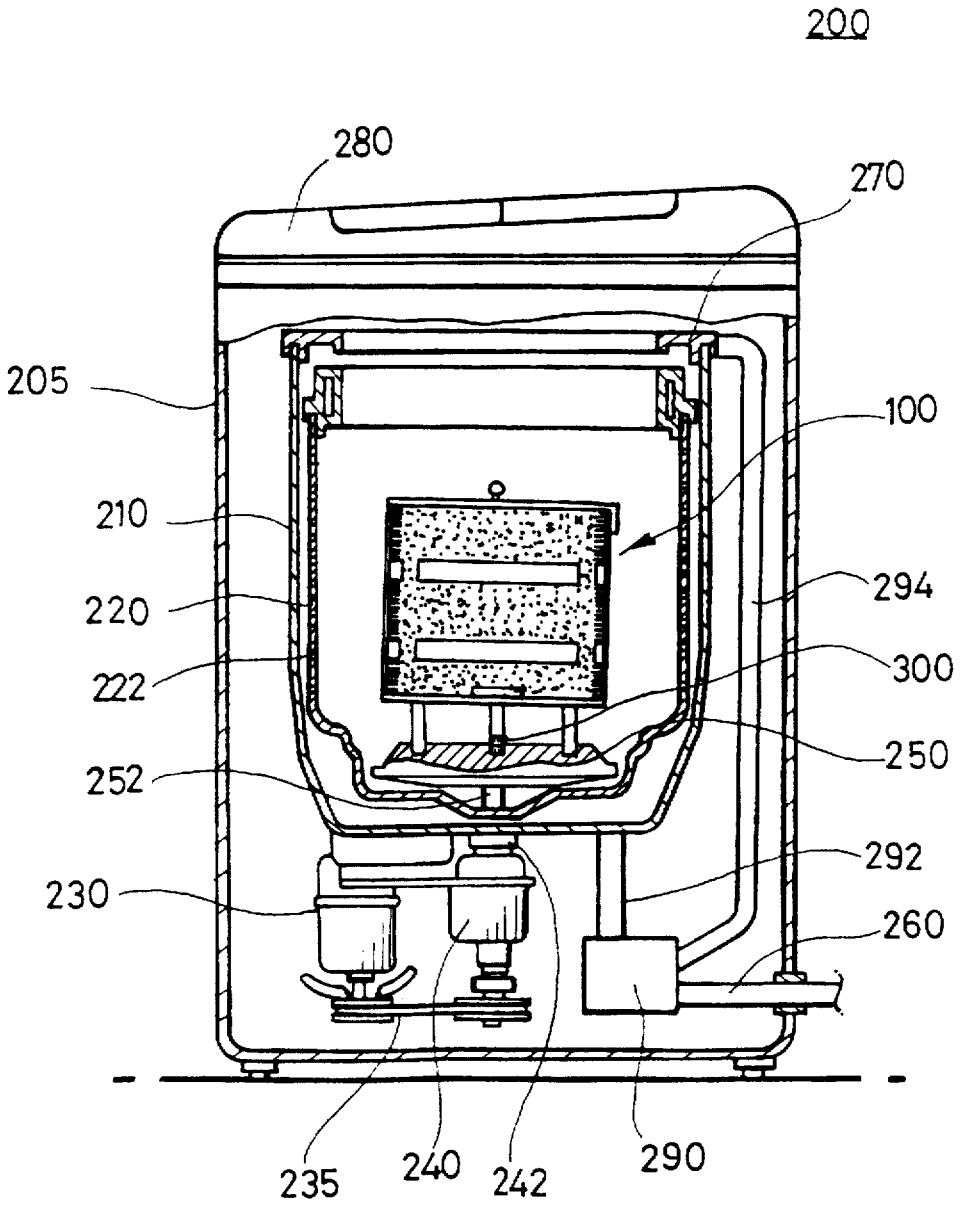
FIG. 1 is a partial sectional view for showing the structure of a washing machine according to one embodiment of the present invention.

FIG. 1 shows a washing machine 200 according to one embodiment of the present invention.

As shown in FIG. 1, washing machine 200 has a housing 205 formed at its upper portion with a housing cover 280. An outer tub 210 for receiving the washing liquid therein, and a spin tub 220, which is accommodated in outer tub 210 and has a plurality of discharging holes 222 at its side wall, are disposed in housing 205. At the bottom wall of spin tub 220, there is provided a pulsator 250 for generating a swirl-shaped liquid flow in spin tub 220.

In addition, a motor 230 for generating a rotational force, a gear assembly 240 which is connected to motor 230 by means of a belt 235 in order to receive the rotational force from motor 230, and a circulation pump 290 communicated with outer tub 210 through a discharge tube 292 are disposed at the lower portion of housing 205.

In order to transfer the rotational force from motor 230 to pulsator 250, a connection member 242 is disposed between a rotating shaft 252 of pulsator 250 and gear assembly 240. Circulation pump 290 circulates the washing liquid into a spraying nozzle apparatus 270, which is mounted on the upper portion of outer tub 210 through a circulation tube 294, or drains the washing liquid out of washing machine 200 through a drain tube 260, alternatively.

On the other hand, a detachable washing bucket 100 for receiving extremely dirty clothing or shoes is mounted on pulsator 250 in spin tub 220.

Figure 2:
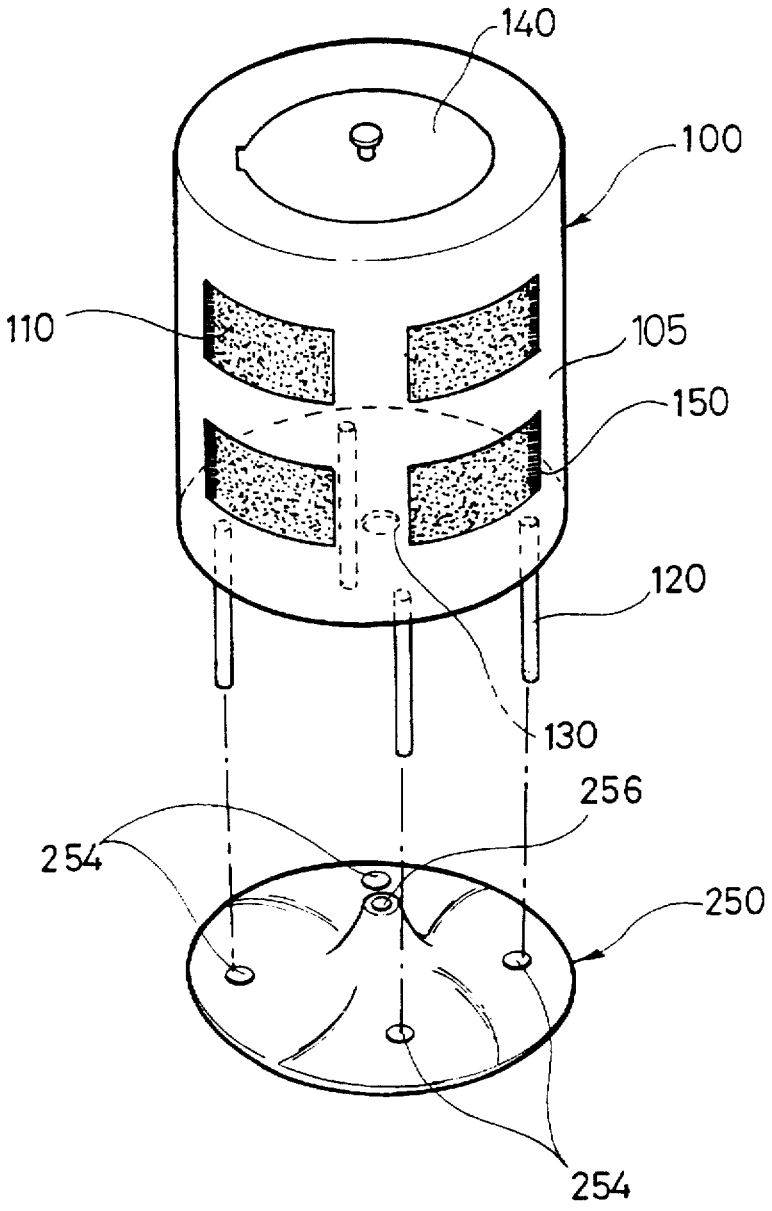
FIG. 2 is a perspective view of a detachable washing bucket and a pulsator shown in FIG. 1.
Figure 3:
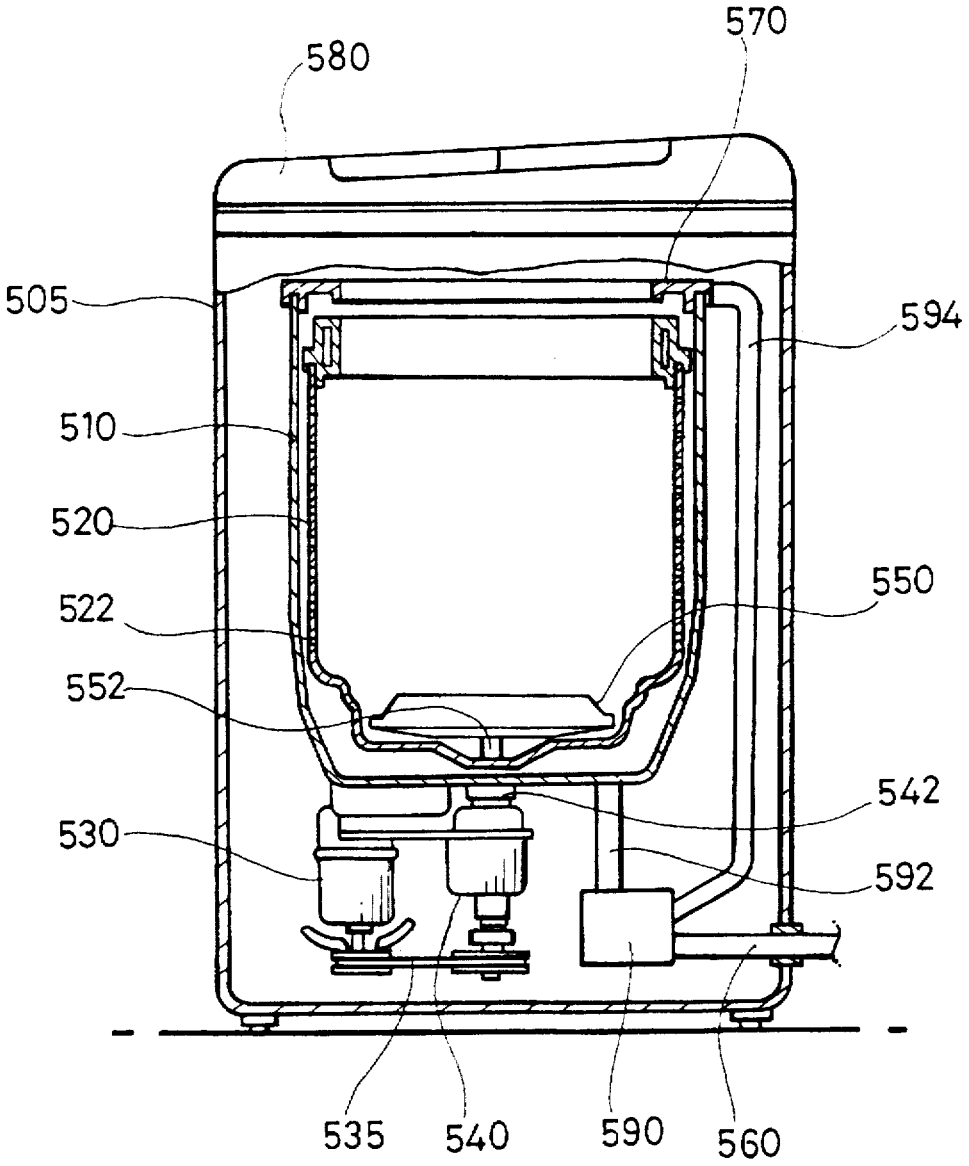
FIG. 3 (PRIOR ART)
FIG. 3 is a partial sectional view for showing the structure of a conventional washing machine.

Referring to FIG. 2, detachable washing bucket 100 has a body 105. Body 105 has a cylindrical shape so as to easily rotate according to the rotation of pulsator 250. A washing bucket cover 140 is hinged to the upper portion of body 105. Washing bucket cover 140 prevents the articles in detachable washing bucket 100 from coming out of detachable washing bucket 100 by the centrifugal force applied thereto.

In addition, body 105 has a plurality of cutting portions 110 at its cylindrical side wall so that the swirl-shaped liquid flow that has generated in spin tub 220 may easily flow into detachable washing bucket 100. Each of cutting portions 110 is regularly spaced along the cylindrical side wall of body. The size and shape of cutting portion 110 can be varied according to the various embodiments of the present invention. According to the preferred embodiment of the present invention, cutting portion 110 has a rectangular shape and the size of cutting portion 110 is predetermined such that the articles loaded in detachable washing bucket 100 do not move out of detachable washing bucket 100 through cutting portion 110.

Meanwhile, a washing brush 150 is formed at the inner wall of body 105. As detachable washing bucket 100 rotates, the articles loaded in detachable washing bucket 100 are subjected to the centrifugal force so that the articles are forced toward the inner wall of body 105. Therefore, the articles are in contact with washing brush 150 while detachable washing bucket 100 rotates, thereby improving the washing effect.

In addition, body 105 is formed at its under side with guide pins 120 which extend downwards therefrom. All guide pins 120 are securely inserted in guide holes 254 which are formed at the upper surface of pulsator 250 in correspondence to guide pins 120, so that the rotational force of pulsator 250 may transfer to detachable washing bucket 100 and thereby detachable washing bucket 100 can be rotated together with pulsator 250.

Preferably, guide pins 120 are integrally formed with the under side of body 105. The number of guide pins 120 vary according to the various embodiments of the present invention. According to the preferred embodiment of the present invention, four guide pins 120 are disposed at the under side of body 105 in such a manner that they are regularly spaced in the circumference direction apart from each other. Therefore, four guide holes 254 are formed on the upper surface of pulsator 250 in such a manner that they can be regularly spaced in the circumference direction with each other.

On the other hand, guide pins 120 may separate from guide holes 254 due to the centrifugal force or vibrations thereof while detachable washing bucket 100 is being rotated. In order to prevent guide pins 120 from separating, a bolt 300 is screwed in so that it passes through a perforation hole 130 formed at the center of bottom wall of body 105 into a screw hole 256 formed at the center of the upper surface of pulsator 250, thereby detachable washing bucket 100 can be securely fixed to pulsator 250.

Washing machine 200 being constructed as described above according to the present invention operates as follows.

Firstly, when it is necessary to wash general articles, the user separates detachable washing bucket 100 from pulsator 250 and puts the articles into spin tub 220. Then, as the user turns on the operating switch, washing machine 200 performs the washing cycle in a well known manner.

On the other hand, when it is necessary to wash extremely dirty clothing or shoes, the user inserts guide pins 120 of detachable washing bucket 100 into guide holes 254 of pulsator 250 and fixes detachable washing bucket 100 to pulsator 250 by means of bolt 300. After that, the user puts the extremely dirty articles into detachable washing bucket 100.

In this state, as the user turns on the operating switch installed on housing cover 280, an operating signal is inputted to an electrical control unit (ECU, not shown) which is installed in washing machine 200. Upon receiving the operating signal, the ECU applies an open signal to a liquid feeding control valve (not shown) according to a predetermined algorithm which is preset in the ECU, so that the washing liquid is supplied from the liquid source into outer tub 210 through the liquid feeding control valve.

The washing liquid is continuously supplied until it has reached a predetermined liquid level in outer tub 210. The predetermined liquid level is the liquid level at which the articles loaded in detachable washing bucket 100 are fully submerged in the washing liquid supplied thereto.

When the liquid level in outer tub 210 reaches the predetermined liquid level, the ECU applies a close signal to the liquid feeding control valve. At the same time, the ECU applies an operating signal to motor 230 so that motor 230 periodically rotates in the forward and reverse directions.

The rotational force of motor 230 is transmitted to rotating shaft 252 of pulsator 250 by way of belt 235, gear assembly 240, and connection member 242 so that pulsator 250 rotates in the forward and reverse directions, thereby generating the swirl-shaped liquid flow in spin tub 220.

The swirl-shaped liquid flow that has generated in spin tub 220 passes through cutting portion 110 formed at the side wall of body 105 and collides with the articles loaded in detachable washing bucket 100, thereby separating dirt from the articles.

On the other hand, as stated above, since detachable washing bucket 100 securely coupled to pulsator 250 also rotates in the forward and reverse directions together with pulsator 250, the articles loaded in detachable washing bucket 100 are subjected to the centrifugal force as detachable washing bucket 100 rotates. Therefore, the articles are forced toward the inner wall of detachable washing bucket 100 and move along the inner wall of detachable washing bucket 100.

At this time, washing bucket cover 140 prevents the articles subjected to the centrifugal force from coming out of detachable washing bucket 100.

While moving along the inner wall of detachable washing bucket 100, the articles make contact with washing brush 150 provided at the inner wall of detachable washing bucket 100 so that the articles rub against washing brush 150, thereby dirt which is deeply permeated in the articles is easily separated from the articles by washing brush 150.

In the mean time, since detachable washing bucket 100 periodically rotates in the forward and reverse directions together with pulsator 250, the liquid flow direction in detachable washing bucket 100 is also periodically reversed. Accordingly, the articles which move along the liquid flow contact fully with washing brush 150, thereby effectively removing dirt deeply permeated in the articles such as stains or blots.

In particular, in the event of washing clothes made of stiff textiles or shoes, the washing effect is greatly improved by washing brush 150.

As described above, the washing machine of the present invention can wash even the extremely dirty articles without manually washing the articles in advance.

Further, since the articles in the detachable washing bucket are rubbed by the washing brush provided at the inner wall of the detachable washing bucket, the washing machine of the present invention can effectively remove dirt from clothing as well as from shoes and bags.

While the present invention has been particularly shown and described with reference to the preferred embodiments thereof, it will be understood by those skilled in the art that various changes in form and details may be effected therein without departing from the spirit and scope of the invention as defined by the appended claims.

What is claimed is:

1. A washing machine comprising:

a housing;

an outer tub disposed in the housing so as to receive a washing liquid from a liquid source;

a spin tub accommodated in the outer tub;

a motor for generating a driving force, the motor disposed at a lower portion of the outer tub;

a first means for generating a swirl-shaped liquid flow in the spin tub, the first means being rotated by the motor, the first means including a pulsator mounted on a bottom wall of the spin tub;

a second means for receiving an extremely dirty article so as to wash the article therein, the second means being rotated as the first means rotates the second means including a washing bucket mounted on an upper surface of the pulsator, the washing bucket having a body which is formed at its upper portion with a washing bucket cover for preventing the article from moving out of the washing bucket, the body being formed at its side wall with a plurality of cutting portions for receiving the washing liquid from the spin tub, the body being formed at its inner wall with a washing brush; and a third means for detachably assembling the second means to the first means.

2. The washing machine as claimed in claim 1, wherein the washing bucket cover is hinged to the upper portion of the body.

3. The washing machine as claimed in claim 1, wherein the cutting portions have a rectangular shape.

4. The washing machine as claimed in claim 1, wherein the body has a cylindrical shape so as to easily rotate according to a rotation of the pulsator, and the cutting portions are regularly spaced along the cylindrical side wall of the body.

5. The washing machine as claimed in claim 4, wherein the body has a perforation hole at a center thereof, the pulsator has a screw hole and at least one guide hole at the upper surface of the pulsator, and the third means includes a bolt and at least one guide pin, the screw hole being formed at a center of the pulsator, the guide hole being positioned around the screw hole, the bolt being inserted in the screw hole through the perforation hole, the guide pin being formed at an underside of the body and extending downwards therefrom so as to be inserted into the guide hole.

6. The washing machine as claimed in claim 5, wherein the guide pin is integrally formed with the underside of the body.

7. The washing machine as claimed in claim 5, wherein the third means includes four guide pins at the underside of the body, and the pulsator has four guide holes at the upper surface of the pulsator, each of the four guide pins being regularly spaced in the circumference direction apart from an adjacent guide pin, each of the four guide holes being disposed in correspondence to the four guide holes.

8. A washing machine comprising:

a housing;

an outer tub disposed in the housing so as to receive a washing liquid from a liquid source;

a spin tub accommodated in the outer tub;

a motor for generating a driving force, the motor disposed at a lower portion of the outer tub;

a pulsator for generating a swirl-shaped liquid flow in the spin tub, the pulsator being mounted on a bottom wall of the spin tub and rotated by the motor, the pulsator having a screw hole and a plurality of guide holes at an upper surface thereof, the screw hole being formed at a center of the pulsator, each of the guide holes being regularly positioned around the screw hole;

a washing bucket for receiving an extremely dirty article so as to wash the article therein, the washing bucket being mounted on the upper surface of the pulsator and rotated together with the pulsator, the washing bucket having a cylindrical body formed with a washing bucket cover, the washing bucket cover being hinged to an upper portion of the body so as to prevent the article from coming out of the washing bucket, the body being formed at its cylindrical side wall with a plurality of rectangular cutting portions for receiving the washing liquid from the spin tub, each of the rectangular cutting portions being regularly spaced along the cylindrical side wall of the body, the body being formed at its inner wall with a washing brush, the body being formed at a center of its bottom wall with a perforation hole;

a bolt for fixing the washing bucket to the pulsator, the bolt being inserted in the screw hole of the pulsator through the perforation hole of the body; and a plurality of guide pins for assembling the washing bucket to the pulsator, the guide pins being integrally formed with an underside of the body and extended downwards therefrom so as to be inserted in the guide holes of the pulsator, each of the guide pins being regularly spaced in the circumference direction apart from an adjacent guide pin.

* * * * *